US008164561B2

(12) United States Patent
Wang et al.

(10) Patent No.: US 8,164,561 B2
(45) Date of Patent: Apr. 24, 2012

(54) DRIVING METHOD

(75) Inventors: Tsang-Hong Wang, Hsinchu (TW); Fang-Lin Chang, Hsinchu (TW); Yun-Chung Lin, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 1154 days.

(21) Appl. No.: 11/775,239

(22) Filed: Jul. 10, 2007

(65) Prior Publication Data

US 2008/0252587 A1 Oct. 16, 2008

(30) Foreign Application Priority Data

Apr. 12, 2007 (TW) ..... 96112825 A

(51) Int. Cl.
*G09G 3/34* (2006.01)

(52) U.S. Cl. ..... 345/100

(58) Field of Classification Search ..... 345/98–100, 345/87

See application file for complete search history.

(56) References Cited

U.S. PATENT DOCUMENTS

| | | | | |
|---|---|---|---|---|
| 4,908,710 | A * | 3/1990 | Wakai et al. | 348/793 |
| 6,075,505 | A | 6/2000 | Shiba et al. | |
| 6,140,990 | A * | 10/2000 | Schlig | 345/92 |
| 6,445,372 | B1 * | 9/2002 | Asai | 345/99 |
| 6,982,690 | B2 | 1/2006 | Lee et al. | |
| 7,145,544 | B2 | 12/2006 | Oohira | |
| 7,369,124 | B2 * | 5/2008 | Nakano et al. | 345/204 |
| 7,468,718 | B2 * | 12/2008 | Shin | 345/98 |
| 2002/0047818 | A1 * | 4/2002 | Yamamoto et al. | 345/87 |
| 2003/0034939 | A1 * | 2/2003 | Moon | 345/76 |
| 2003/0122758 | A1 | 7/2003 | Lee et al. | |
| 2005/0212731 | A1 * | 9/2005 | Kawashima | 345/76 |
| 2007/0171165 | A1 * | 7/2007 | Chuang et al. | 345/88 |
| 2008/0136765 | A1 * | 6/2008 | Neugebauer | 345/98 |
| 2008/0180369 | A1 * | 7/2008 | Chiu et al. | 345/87 |
| 2009/0002355 | A1 * | 1/2009 | Iwatsu | 345/205 |

FOREIGN PATENT DOCUMENTS

| | | |
|---|---|---|
| CN | 1432173 | 7/2003 |
| JP | 2100092 | 4/1990 |
| JP | 2004-13115 A * | 1/2004 |
| TW | 200406730 | 5/2004 |
| TW | I247265 | 1/2006 |
| TW | 200630938 | 9/2006 |

OTHER PUBLICATIONS

"Office Action of Taiwan Counterpart Application", issued on Jan. 9, 2012, p1-p5, in which the listed reference was cited.

* cited by examiner

*Primary Examiner* — Richard Hjerpe
*Assistant Examiner* — Jeffrey A Parker
(74) *Attorney, Agent, or Firm* — Jianq Chyun IP Office

(57) ABSTRACT

A driving method for driving a display panel is provided. The display panel includes a plurality of scan lines, a plurality of data lines, and a plurality of pixel units electrically connected to the scan lines and the data lines. The driving method comprises enabling the pixel units controlled by the scan lines through different scanning sequences and inputs image data to the pixel units via the data lines in several consecutive frame times, wherein capacitance coupling effects between the pixel units are varied depending on the scanning sequences. Accordingly, the line mura caused by the capacitance coupling effect is restrained.

3 Claims, 8 Drawing Sheets

DRIVING METHOD

CROSS-REFERENCE TO RELATED APPLICATION

This application claims the priority benefit of Taiwan application serial no. 96112825, filed Apr. 12, 2007. All disclosure of the Taiwan application is incorporated herein by reference.

BACKGROUND OF THE INVENTION

1. Field of the Invention

The present invention relates to a driving method. More particularly, the present invention relates to a driving method for a liquid crystal display (LCD).

2. Description of Related Art

The proliferation of multi-media systems in our society depends to a large extent on the progressive development of semiconductor devices and display devices. Display devices such as the cathode ray tube (CRT) have been used for quite some time due to its remarkable display quality, reliability and low cost. Although the conventional CRT has many advantages, the design of the electron gun renders it heavy, bulky and energy wasting. Moreover, there is always some potential risk of hurting viewer's eyes due to its emission of some radiation. With big leaps in the techniques of manufacturing semiconductor devices and optoelectronic devices, high picture quality, slim, low power consumption and radiation-free displays such as the thin film transistor liquid crystal displays (TFT LCD) have gradually become mainstream display products.

FIG. 1 is a schematic view of a conventional active device array. Referring to FIG. 1, a display panel 10 includes a plurality of scan lines G1-Gn, a plurality of data lines S1-Sm, and a plurality of pixel units 2 having active devices 2*a*. The scan lines G1-Gn and the data lines S1-Sm are electrically connected to the active devices 2*a* of the pixel units 2 correspondingly and the pixel units 2 are driven by the scan lines G1-Gn and the data lines S1-Sm. In particular, the display panel 10 further includes a plurality of shift registers (not shown), and the shift registers generate scanning control signals which cooperate with the data signals to enable the pixel units 2 at a proper time, so as to input-image data to the pixel units 2.

FIG. 2 is a timing diagram of a driving method of the active device array in FIG. 1. Referring to FIG. 2, in each frame time, the scanning control signals SR(G1)-SR(Gn) input to the scan lines G1-Gn sequentially enable the pixel units 2 through the same scanning sequence, for example, the sequence of SR(G1), SR(G2), SR(G3) . . . SR(Gn−1), SR(Gn). When the driving method of FIG. 2 is employed to drive the active device array 10, and the pixel units 2 controlled by the odd scan lines SR(G1), SR(G3) . . . and the pixel units 2 controlled by the even scan lines SR(G2), SR(G4) . . . are under non-uniform charging conditions, and line mura may occur in a direction parallel to the data lines S1-Sm. For example, when the scanning control signal SR(G1) is input to the scan line G1, an image data is input to the pixel unit 2 connected to the scan line G1 and the data line S1. When the scanning control signal SR(G2) is input to the scan line G2, another image data is input to the pixel unit 2 connected to the scan line G2 and data line S1. At this time, the image data recorded in the pixel unit 2 on the left of the data line S1 may be affected or coupled by the image data recorded in the pixel unit 2 on the right of the data line S1 (i.e., the capacitance coupling effect), thus causing non-uniform brightness. As a result, the capacitance coupling effect should be reduced.

SUMMARY OF THE INVENTION

The present invention is directed to providing a driving method to restrain the line mura of the display panel.

As embodied and broadly described herein, the present invention provides a driving method for driving a display panel including a plurality of scan lines, a plurality of data lines, and a plurality of pixel units electrically connected to the scan lines and the data lines. The driving method comprises enabling the pixel units controlled by the scan lines through different scanning sequences and inputting image data to the pixel units via the data lines in several consecutive frame times, wherein capacitance coupling effects between the pixel units are varied depending on the scanning sequences.

In the present invention, the pixel units are enabled through different sequences in several consecutive frame times, so as to improve the non-uniform brightness due to capacitance coupling effects between the pixel units, thereby restraining the line mura caused by the non-uniform brightness.

In order to make the aforementioned features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The First Embodiment

Figure 1:
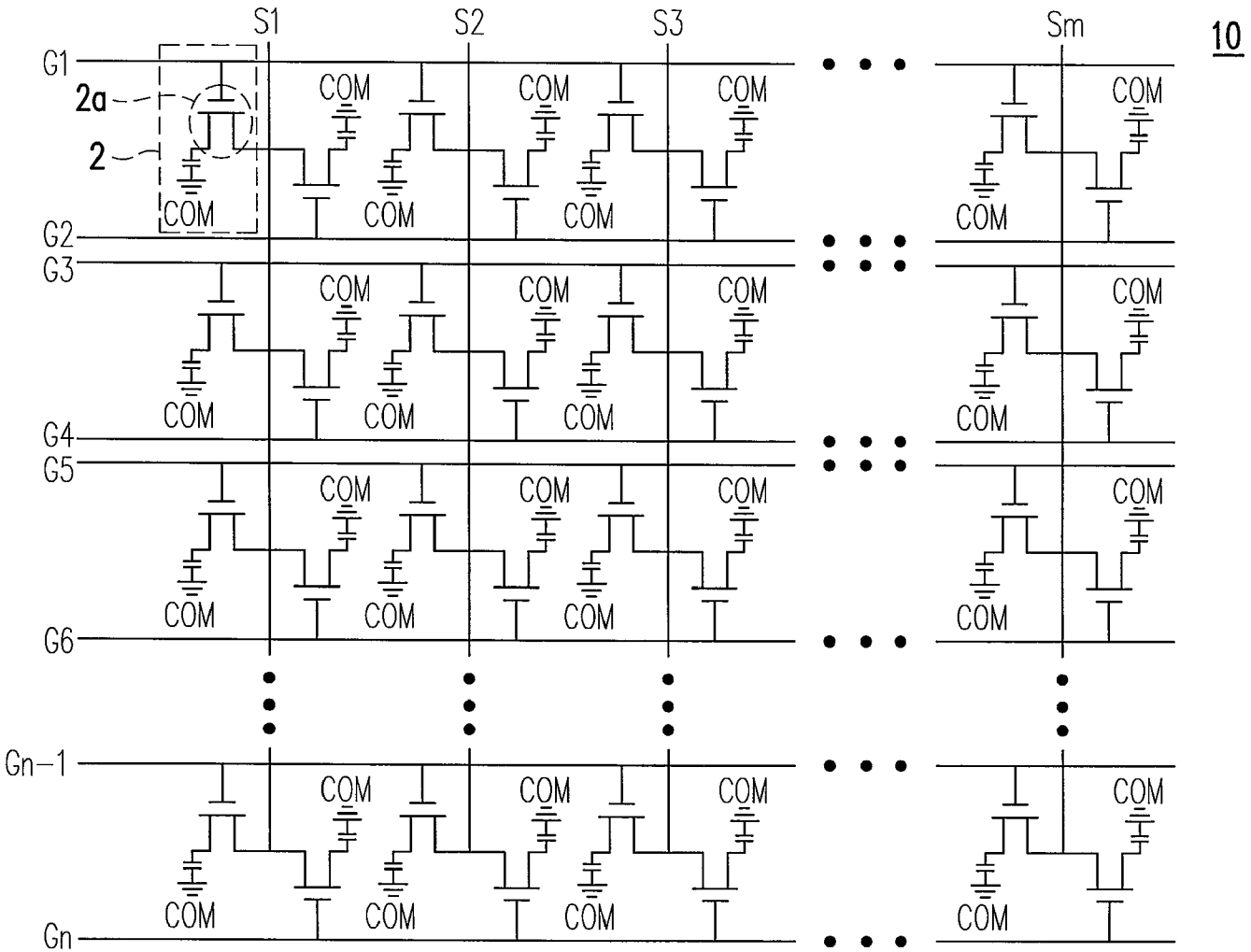
FIG. 1 (PRIOR ART)
FIG. 1 is a schematic view of a conventional active device array.
Figure 2:
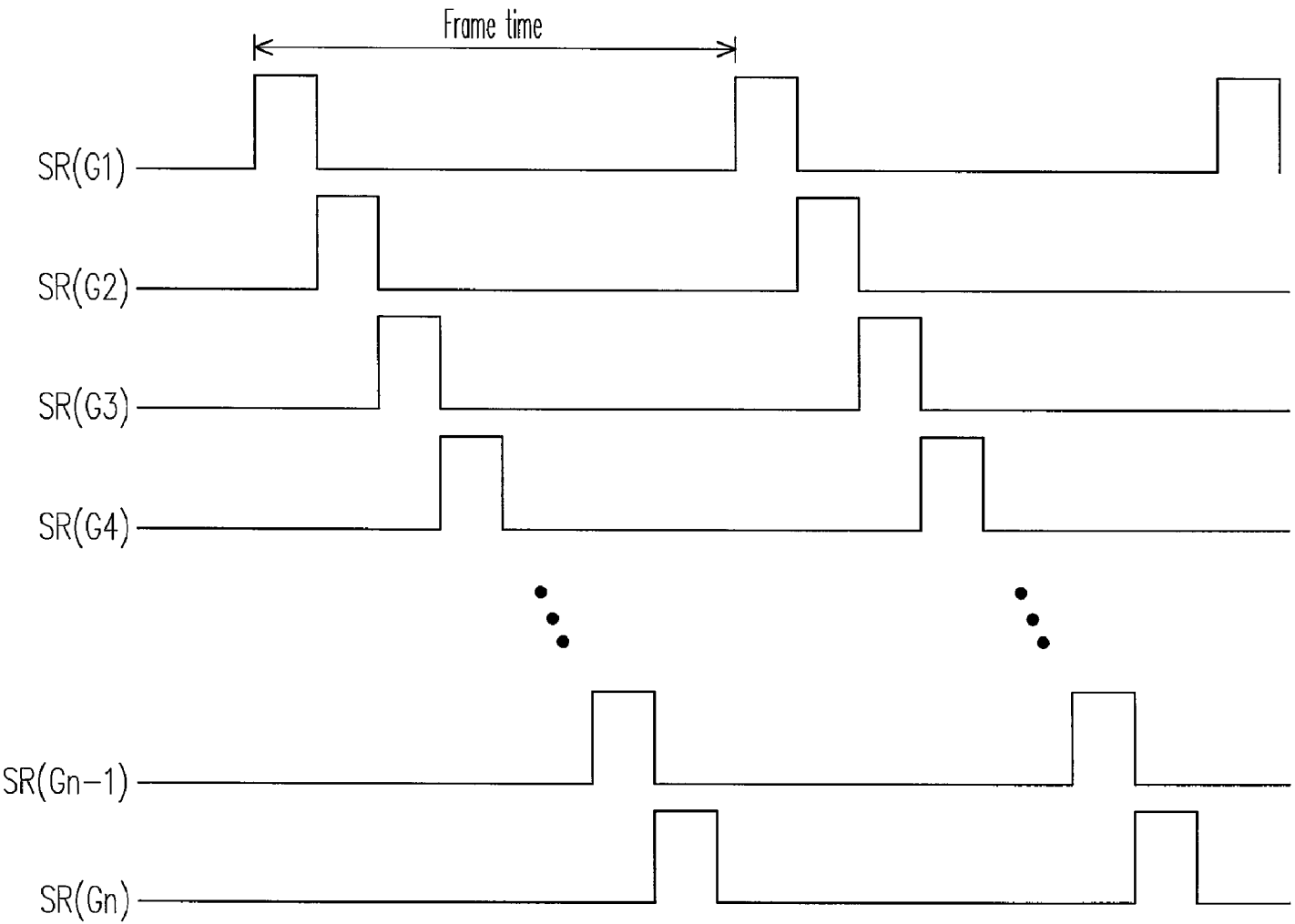
FIG. 2 is a timing diagram of a driving method of the active device array in FIG. 1.
Figure 3A:
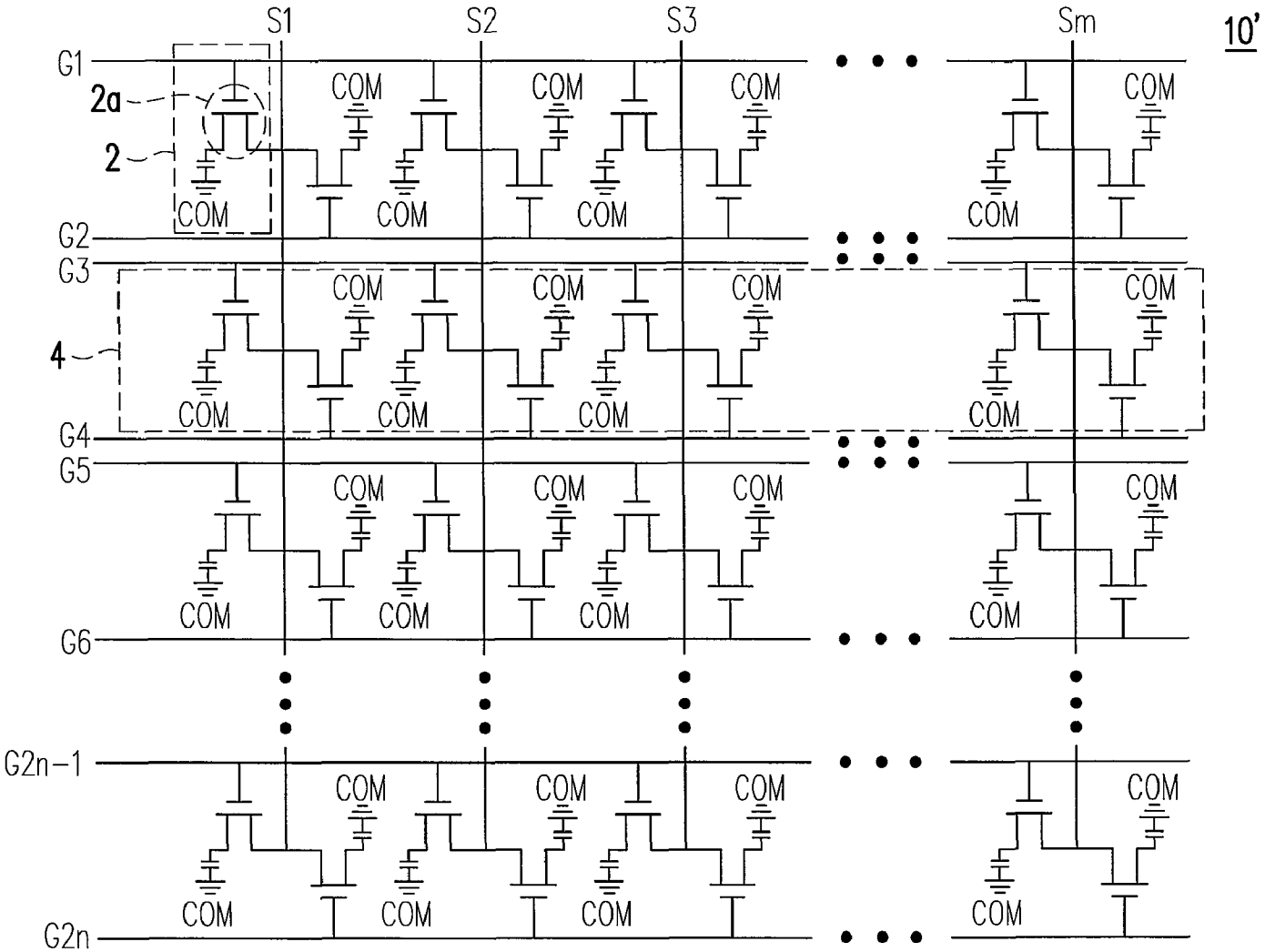
FIG. 3A is a display panel according to a first embodiment of the present invention.
Figure 3B:
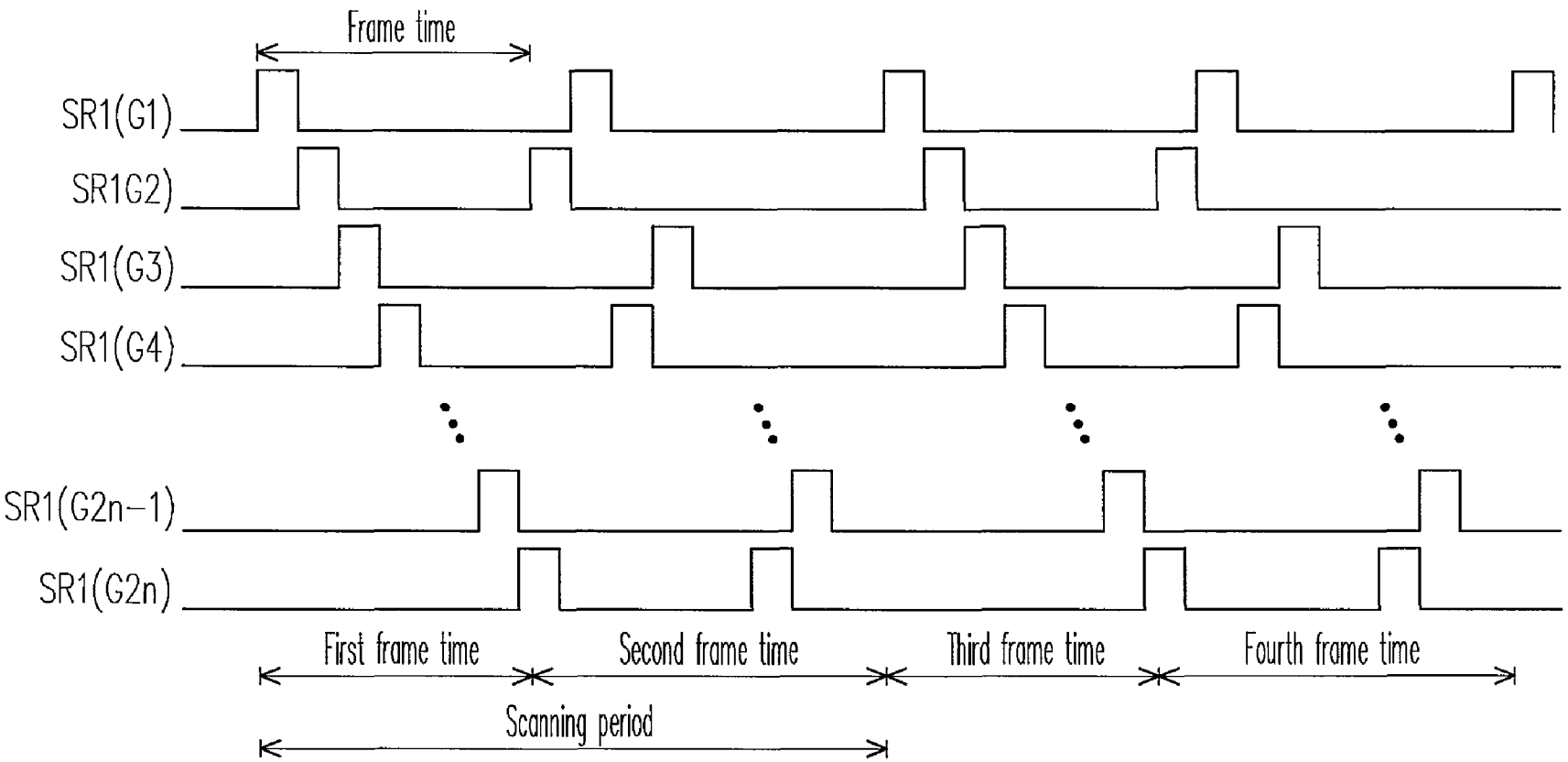
FIG. 3B is a timing diagram of a driving method of the display panel in FIG. 3A.

FIG. 3A is a display panel according to a first embodiment of the present invention, and FIG. 3B is a timing diagram of scanning control signals SR1(G1)-SR1(G2*n*) according to the first embodiment of the present invention. Referring to FIGS. 3A and 3B, a display panel 10' includes a plurality of scan lines G1-G2*n*, a plurality of data lines S1-Sm, and a plurality of pixel units 2 having active devices 2*a*, wherein n, m are positive integers. The scan lines G1-G2*n* and the data lines S1-Sm are electrically connected to the active devices 2*a* of the pixel units 2 correspondingly. In this embodiment, all the pixel units 2 are divided into a plurality of display bands 4, and each of the display bands 4 is constituted by pixel units 2 controlled by two adjacent scan lines. The pixel units 2 in each of the display bands 4 are driven by the corresponding scan lines G1-G2*n* and corresponding data lines S1-Sm. The scanning control signals SR1(G1)-SR1(G2*n*) are respectively input to the scan lines G1-G2*n* to enable the pixel units 2 controlled by the scan lines G1-G2*n*.

In this embodiment, a rising edge of the scanning control signals SR1(G1)-SR1(G2*n*) enables the pixel units 2 controlled by the scan lines G1-G2*n*, and a falling edge of the scanning control signals SR1(G1)-SR1(G2*n*) disables the pixel units 2 controlled by the scan lines G1-G2*n*. However, in other embodiments of the present invention, the falling edge of the scanning control signals SR1(G1)-SR1(G2*n*) enables the pixel units 2, and the rising edge of the scanning control signals SR1(G1)-SR1(G2*n*) disables the pixel units 2. More particularly, in an embodiment of the present invention, the enable signal (the rising edge or the falling edge) of the scanning control signals SR1(G1)-SR1(G2*n*) cooperates with the data signals (not shown) transmitted by the data lines S1-Sm to input an image data to the pixel units 2. In an embodiment of the present invention, the method of inputting the image data to the pixel units 2 via the data lines S1-Sm includes dot inversion driving, line inversion driving, or frame inversion driving.

Referring to FIG. 3B, in the first frame time, the enable signal of the scanning control signals SR1(G1)-SR1(G2*n*) sequentially enables the pixel units 2 controlled by the scan lines G1, G2, G3, G4, . . . , G2*n*−1, G2*n* in each row. In the second frame time, the enable signal of the scanning control signals SR1(G1)-SR1(G2*n*) sequentially enables the pixel units 2 controlled by the scan lines G2, G1, G4, G3, . . . G2*n*, G2*n*−1 in each row. In other words, in the first frame time, the pixel units 2 controlled by the odd scan lines in the same display band 4 are enabled first, and then the pixel units 2 controlled by the even scan lines are enabled; while in the second frame time, the pixel units 2 controlled by the even scan lines in the same display band 4 are enabled first, and then the pixel units 2 controlled by the odd scan lines are enabled.

Further, the enable sequence of the pixel units 2 in a third frame time is identical to the enable sequence in the first frame time, and the enable sequence of the pixel units 2 in a fourth frame time is identical to the enable sequence in the second frame time. According to an embodiment of the present invention, when the scanning sequences include m scanning sequences, the consecutive frame times (i.e., a scanning period) can be set as (m*k) frame times, and m, k are positive integers.

Figure 3C:
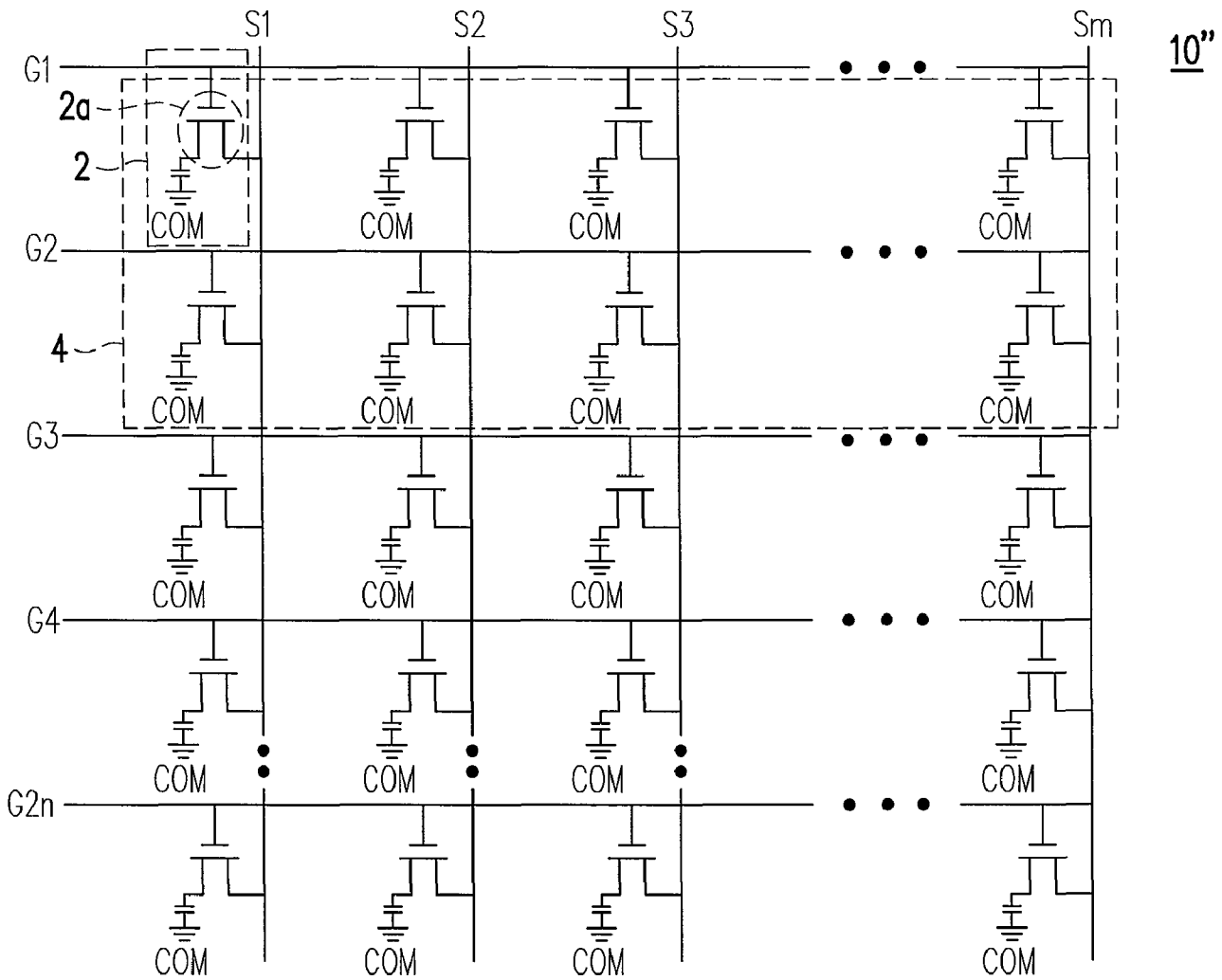
FIG. 3C is a display panel according to another embodiment of the present invention.

In this embodiment, the aforementioned driving method is not limited to be used for driving the display panel shown in FIG. 3A, but can be employed for driving display panels of other configurations, for example, a display panel 10" shown in FIG. 3C.

According to an embodiment of the present invention, the enable signal of the scanning control signals SR1(G1)-SR1(G2*n*) enables the pixel units respectively controlled by each scan line through different scanning sequences in several consecutive frame times. Thus, capacitance coupling effects between the pixel units are varied depending on the scanning sequences, such that the line mura may not easily occur to the display panel.

The Second Embodiment

Figure 4:
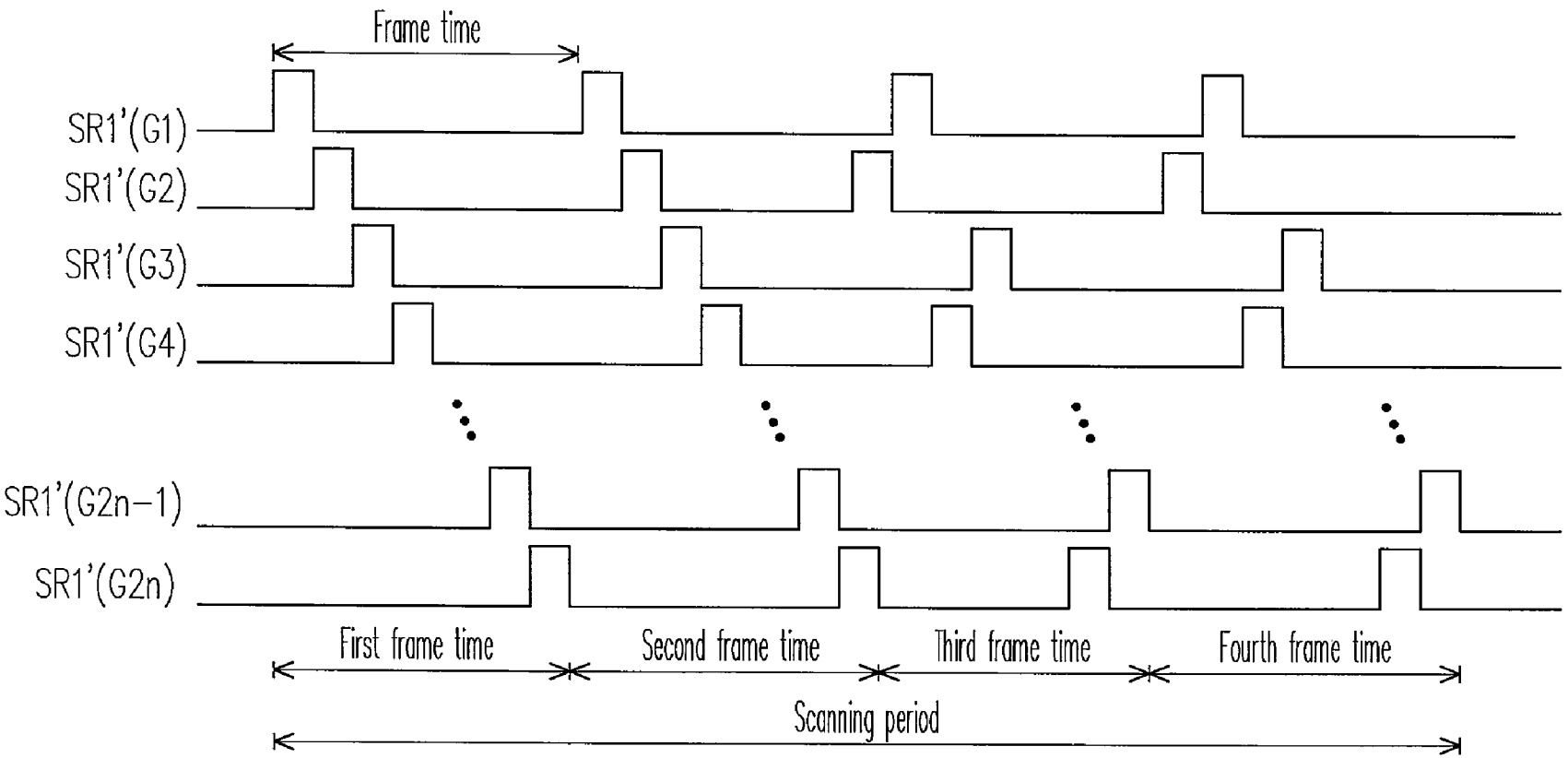
FIG. 4 is a timing diagram of a driving method according to a second embodiment of the present invention.

FIG. 4 is a timing diagram of a driving method according to a second embodiment of the present invention. Referring to FIG. 4, in this embodiment, the scanning period is set to be four frame times. In the first and second frame times, the enable signal of the scanning control signals SR1'(G1)-SR1'(G2*n*) sequentially enables the pixel units 2 controlled by the scan lines G1, G2, G3, G4, . . . , G2*n*−1, G2*n* in each row. In the third and fourth frame times, the enable signal of the scanning control signals SR1'(G1)-SR1'(G2*n*) sequentially enables the pixel units 2 controlled by the scan lines G2, G1, G4, G3, . . . G2*n*, G2*n*−1 in each row.

In this embodiment, each of the display bands 4 is also constituted by pixel units 2 controlled by two adjacent scan lines. In the first and second frame times, the pixel units 2 controlled by the odd scan lines in the same display band 4 are enabled first, and then the pixel units 2 controlled by the even scan lines are enabled. In the third and fourth frame times, the pixel units 2 controlled by the even scan lines in the same display band 4 are enabled first, and then the pixel units 2 controlled by the odd scan lines are enabled.

It should be noted that, though the first and second embodiments respectively adopt two and four frame times as a scanning period to enable the pixel units 2, the scanning period can be set as frame times of a multiple of 2, such as 2, 4, 6 . . . frame times. Similarly, the driving method of this embodiment can be used to drive the display panels 10' or 10" shown in FIG. 3A or FIG. 3D.

The Third Embodiment

Figure 5A:
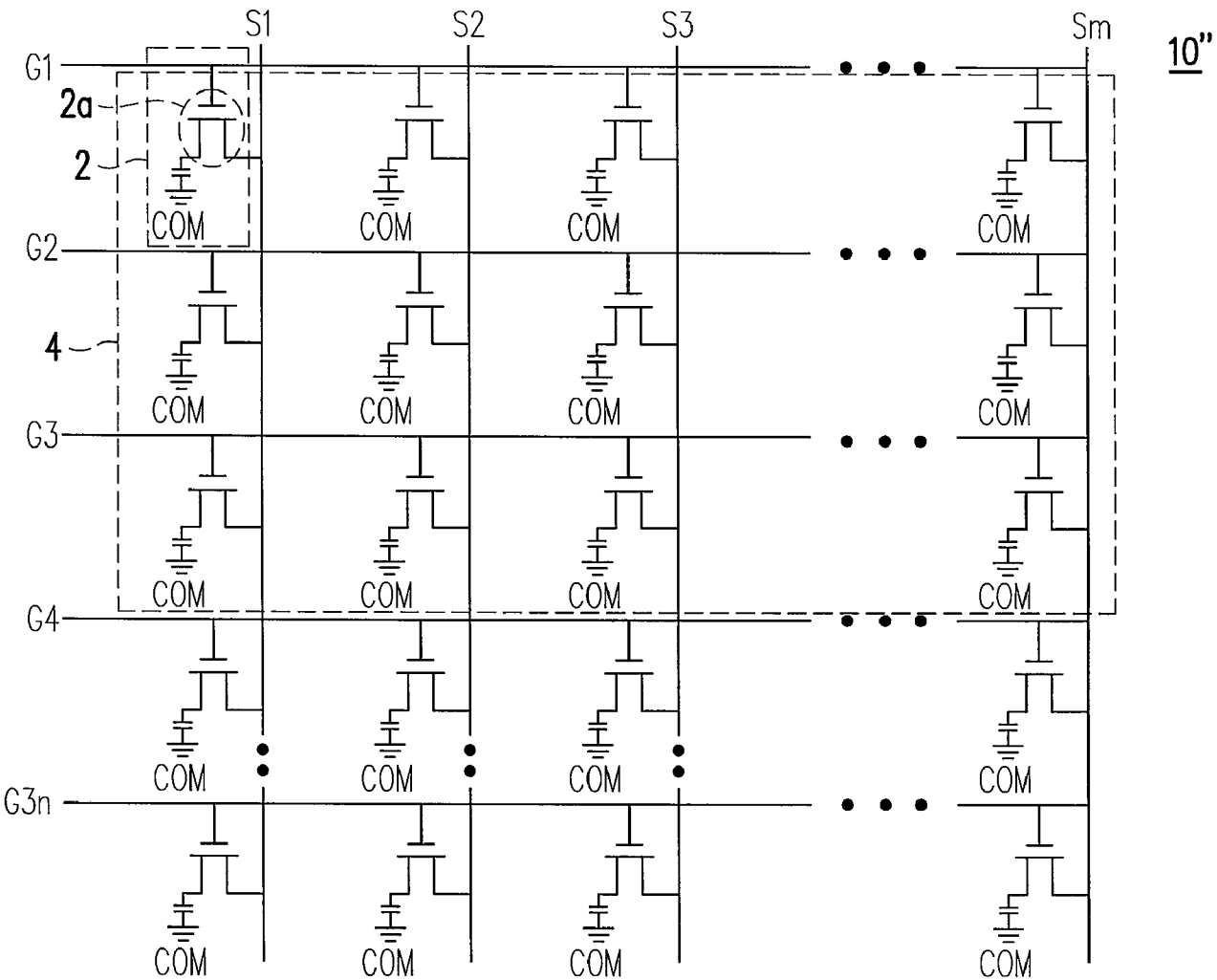
FIG. 5A is a display panel according to a third embodiment of the present invention.
Figure 5B:
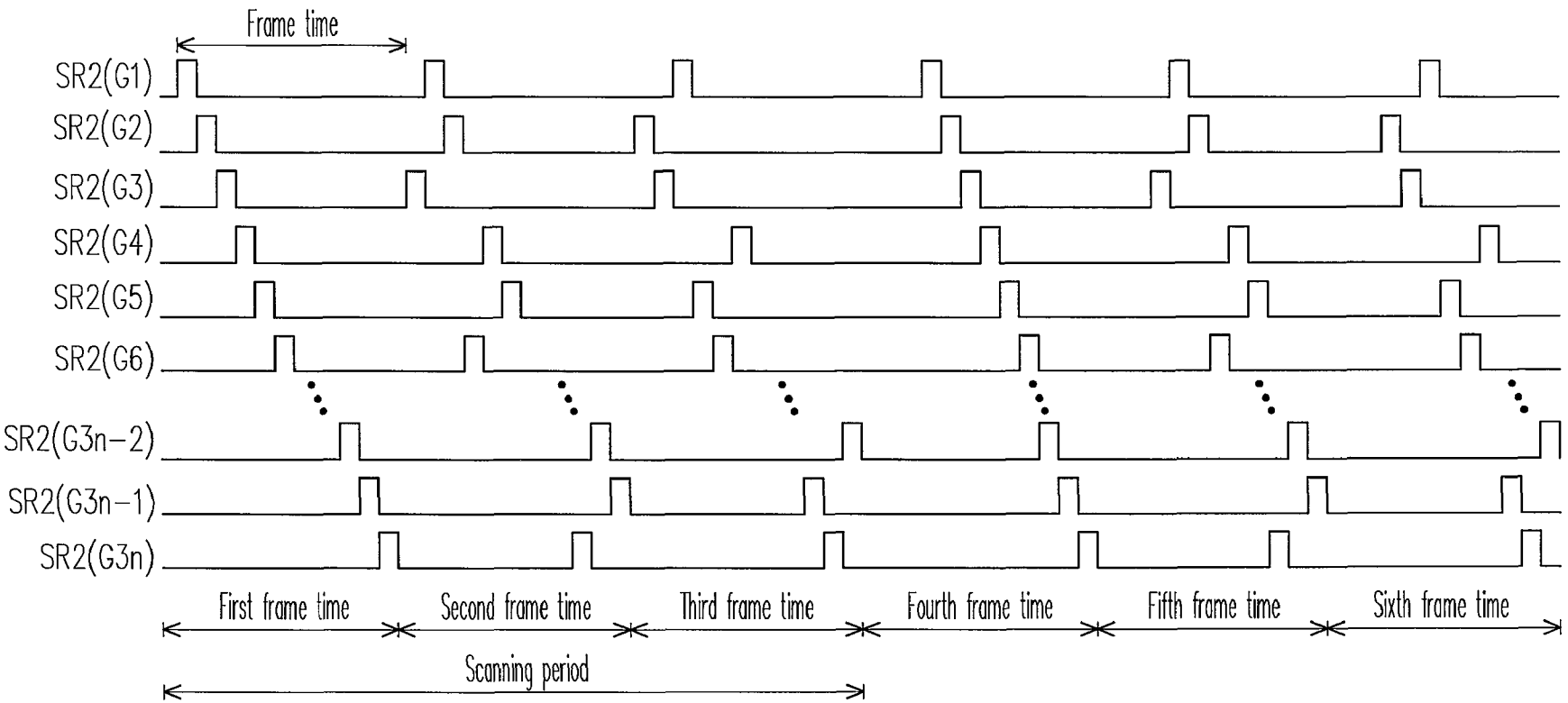
FIG. 5B is a timing diagram of a driving method of the display panel in FIG. 5A.

FIG. 5A is a display panel according to a third embodiment of the present invention, and FIG. 5B is a timing diagram of a driving method of the display panel in FIG. 5A. In the first and second embodiments, each of the display bands 4 is constituted by pixel units 2 controlled by two adjacent scan lines. However, in the present embodiment, each of the display bands 4 is constituted by pixel units 2 controlled by three adjacent scan lines, as shown in FIG. 5A. A detailed description is illustrated below with reference to FIGS. 5A and 5B.

Referring to FIG. 5B, in the first frame time, the enable signal of the scanning control signals SR2(G1)-SR2(G3*n*) sequentially enables the pixel units 2 controlled by the scan lines G1, G2, G3, G4, G5, G6, . . . , G3*n*−2, G3*n*−1, G3*n* in each row. In the second frame time, the enable signal of the scanning control signals SR2(G1)-SR2(G3*n*) sequentially enables the pixel units 2 controlled by the scan lines G3, G1, G2, G6, G4, G5, . . . , G3*n*, G3*n*−2, G3*n*−1 in each row. In the third frame time, the enable signal of the scanning control signals SR2(G1)-SR2(G3*n*) sequentially enables the pixel units 2 controlled by the scan lines G2, G3, G1, G5, G6, G4, . . . , G3*n*−1, G3*n*, G3*n*−2 in each row. That is, in the first frame time, the second frame time, and the third frame time, the enable sequences of pixel units in each row are different.

In addition, the enable sequence of the pixel units 2 in a fourth frame time is identical to the enable sequence in the first frame time, the enable sequence of the pixel units 2 in a fifth frame time is identical to the enable sequence in the second frame time, and the enable sequence of the pixel units 2 in a sixth frame time is identical to the enable sequence in the third frame time. However, in each scanning period, the enable sequences of the pixel units in each row are not limited by this embodiment, and other permutations and combinations of the enable sequences also fall in the scope of the present invention.

It should be noted that, though this embodiment only adopts three frame times as a scanning period to enable the pixel units 2, the scanning period can be set as frame times of a multiple of 3, such as 3, 6, 9 . . . frame times.

Though in the first, second, and third embodiments, each of the display bands is constituted by pixel units controlled by two or three scan lines, it should be understood that the present invention is not limited herein. Moreover, when each of the display bands is constituted by pixel units controlled by x scan lines, the scanning period can be set as x*y frame times, wherein x, y are positive integer, and x>1.

In view of the above, in the present invention, the pixel units are enabled through different sequences in several consecutive frame times, so as to improve the non-uniform brightness due to capacitance coupling effects between the pixel units, thereby restraining the line mura caused by the non-uniform brightness.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving method for driving a display panel comprising a plurality of scan lines, a plurality of data lines, and a plurality of pixel units electrically connected to the scan lines and the data lines, the driving method comprising:

providing scanning control signals to the scan lines so as to correspondingly enable the pixel units electrically connected to the scan lines by different scanning sequences and inputting an image data to each of the pixel units via the data lines in several consecutive frame times, wherein capacitance coupling effects between the pixel units are varied depending on the scanning sequences, wherein the pixel units are arranged in an array, the scanning sequences comprise a first and a second scanning sequences, and the consecutive frame times comprise a first to a fourth frame times, wherein the scanning control signals are sequentially provided to the scan lines in the first scanning sequence from $1^{st}$ scan line to $2^{nd}$ scan line to $3^{rd}$ scan line to $4^{th}$ scan line . . . to $(N-1)^{th}$ scan line to $N^{th}$ scan line in the first frame time, so as to sequentially enable pixel units in each of pixel rows in the first scanning sequence, where N=2i+6, and is a positive integer greater than or equal to 0;

wherein the scanning control signals are sequentially provided to the scan lines in the first scanning sequence from $1^{st}$ scan line to $2^{nd}$ scan line to $3^{rd}$ scan line to $4^{th}$ scan line . . . to $(N-1)^{th}$ scan line to $N^{th}$ scan line in the second frame time, so as to sequentially enable pixel units in each of pixel rows in the first scanning sequence;

wherein the scanning control signals are provided to the scan lines in the second scanning sequence from $2^{nd}$ scan line to $1^{st}$ scan line to $4^{th}$ scan line to $3^{rd}$ scan line . . . to $N^{th}$ scan line to $(N-1)^{th}$ scan line in the third frame time, so as to enable pixel units in each of pixel rows in the second scanning sequence; and wherein the scanning control signals are provided to the scan lines in the second scanning sequence from $2^{nd}$ scan line to $1^{st}$ scan line to $4^{th}$ scan line to $3^{rd}$ scan line . . . to $N^{th}$ scan line to $(N-1)^{th}$ scan line in the fourth frame time, so as to enable pixel units in each of pixel rows in the second scanning sequence.

2. The driving method as claimed in claim 1, wherein a method of inputting the image data to each of the pixel units via the data lines comprises dot inversion driving, line inversion driving, or frame inversion driving.

3. A driving method for driving a display panel comprising a plurality of scan lines, a plurality of data lines, and a plurality of pixel units electrically connected to the scan lines and the data lines, the driving method comprising:

providing scanning control signals to the scan lines so as to correspondingly enable the pixel units electrically connected to the scan lines by different scanning sequences and inputting an image data to each of the pixel units via the data lines in several consecutive frame times, wherein capacitance coupling effects between the pixel units are varied depending on the scanning sequences, wherein the pixel units are arranged in an array; the scanning sequences comprise a first to a third scanning sequences; and the consecutive frame times comprise a first to a third frame times, wherein the scanning control signals are sequentially provided to the scan lines in the first scanning sequence from $1^{st}$ scan line to $2^{nd}$ scan line to $3^{rd}$ scan line to $4^{th}$ scan line to $5^{th}$ scan line to $6^{th}$ scan line . . . to $(N-2)^{th}$ scan line to $(N-1)^{th}$ scan line to $N^{th}$ scan line in the first frame time, so as to sequentially enable pixel units in each of pixel rows in the first scanning sequence, where N=3i+9, and i is a positive integer greater than or equal to 0;

wherein the scanning control signals are provided to the scan lines in the second scanning sequence from $3^{rd}$ scan line to $1^{st}$ scan line to $2^{nd}$ scan line to $6^{th}$ scan line to $4^{th}$ scan line to $5^{th}$ scan line . . . to $N^{th}$ scan line to $(N-2)^{th}$ scan line to $(N-1)^{th}$ scan line in the second frame time, so as to enable pixel units in each of pixel rows in the second scanning sequence; and wherein the scanning control signals are provided to the scan lines in the third scanning sequence from $2^{nd}$ scan line to $3^{rd}$ scan line to $1^{st}$ scan line to $5^{th}$ scan line to $6^{th}$ scan line to $4^{th}$ scan line . . . to $(N-1)^{th}$ scan line to $N^{th}$ scan line to $(N-2)^{th}$ scan line in the third frame time, so as to enable pixel units in each of pixel rows in the third scanning sequence.

* * * * *